US009371687B2

(12) United States Patent
Yu et al.

(10) Patent No.: US 9,371,687 B2
(45) Date of Patent: Jun. 21, 2016

(54) MOTORIZED WINDOW SHADE AND METHOD OF OPERATING THE SAME

(71) Applicant: Teh Yor Co., Ltd., Taipei (TW)

(72) Inventors: Fu-Lai Yu, New Taipei (TW); Chin-Tien Huang, New Taipei (TW); Chien-Fong Huang, City of Industry, CA (US)

(73) Assignee: TEH YOR CO., LTD. (TW)

( * ) Notice: Subject to any disclaimer, the term of this patent is extended or adjusted under 35 U.S.C. 154(b) by 0 days.

(21) Appl. No.: 14/324,285

(22) Filed: Jul. 7, 2014

(65) Prior Publication Data

US 2015/0191970 A1 Jul. 9, 2015

Related U.S. Application Data

(60) Provisional application No. 61/923,275, filed on Jan. 3, 2014, provisional application No. 61/938,782, filed on Feb. 12, 2014.

(51) Int. Cl.

| | |
|---|---|
| ***E06B 9/38*** | (2006.01) |
| ***E06B 9/262*** | (2006.01) |
| ***E06B 9/68*** | (2006.01) |

(52) U.S. Cl.

CPC . *E06B 9/38* (2013.01); *E06B 9/262* (2013.01); *E06B 9/68* (2013.01); *E06B 2009/2625* (2013.01); *E06B 2009/6845* (2013.01); *E06B 2009/6872* (2013.01)

(58) Field of Classification Search

CPC ..... E06B 9/68; E06B 9/70; E06B 9/72; E06B 9/32; E06B 9/322; E06B 2009/6845; E06B 2009/689; E06B 9/38; E06B 9/262; E06B 2009/2625

See application file for complete search history.

(56) References Cited

U.S. PATENT DOCUMENTS

| | | | | |
|---|---|---|---|---|
| 5,848,634 | A * | 12/1998 | Will | E06B 9/174 160/1 |
| 2003/0000653 | A1* | 1/2003 | Ulatowski | E06B 9/361 160/84.02 |
| 2003/0145957 | A1 | 8/2003 | Domel et al. | |
| 2012/0261078 | A1* | 10/2012 | Adams | E06B 9/32 160/6 |
| 2015/0034257 | A1* | 2/2015 | Blair | E06B 9/42 160/121.1 |
| 2015/0191970 | A1* | 7/2015 | Yu | E06B 9/262 160/84.02 |

OTHER PUBLICATIONS

Translations into English of the Abstracts of the non-English cited references.

* cited by examiner

*Primary Examiner* — Blair M Johnson

(74) *Attorney, Agent, or Firm* — Baker & McKenzie LLP; David I. Roche

(57) ABSTRACT

A motorized window shade includes a covering structure arranged between a fixed and a movable rail, an electric motor operable to drive displacement of the movable rail relative to the fixed rail, a control interface operable to control operation of the electric motor, and a motor controller respectively connected with the electric motor and the control interface. The control interface includes a first, a second and a third button, the first and second buttons being respectively operable to cause displacement of the movable rail in two opposite directions. The motor controller can record a current position of the movable rail as a limit position of the movable rail in response to a pressure concurrently applied on the third button and one of the first and second buttons. In some embodiments, methods of operating the motorized window shade are also described.

23 Claims, 12 Drawing Sheets

MOTORIZED WINDOW SHADE AND METHOD OF OPERATING THE SAME

CROSS-REFERENCE TO RELATED APPLICATIONS

This application respectively claims priority to U.S. Provisional Patent Application No. 61/923,275 filed on Jan. 3, 2014, and to U.S. Provisional Patent Application No. 61/938,782 filed on Feb. 12, 2014, both of which are incorporated herein by reference.

BACKGROUND

1. Field of the Invention

The present invention relate to motorized window shades and methods of operating the motorized window shades.

2. Description of the Related Art

Certain window shades may be provided with a motor that allows to conveniently raise and lower the shade. The motor and its power source may be disposed in a support structure mounted at a top of a window frame, and a remote controller may be provided to wirelessly control the operation of the motor. This type of motorized window shades is suitable for relatively higher end products, but not for lower end products owing to a higher manufacture cost. Moreover, while current motorized window shades may be able to set the upper and lower limit positions of the shade, the settings of the limit positions usually require multiple complex operating steps which may not be easily understood by a user.

Therefore, there is a need for a motorized window shade that is convenient to operate, economical to fabricate, and address at least the foregoing issues.

SUMMARY

The present application describes a motorized window shade that is easy to operate for setting limit positions. In one embodiment, the motorized window shade includes a fixed rail, a movable rail, and a covering structure arranged between the fixed rail and the movable rail. The window shade also includes an electric motor operable to drive displacement of the movable rail relative to the fixed rail, a control interface operable to control operation of the electric motor, and a motor controller respectively connected with the electric motor and the control interface. The control interface includes a first, a second and a third button, the first button being operable to cause displacement of the movable rail in a first direction, and the second button being operable to cause displacement of the movable rail in a second direction opposite to the first direction. The motor controller is configured to record a current position of the movable rail as a limit position of the movable rail in response to a pressure concurrently applied on the third button and one of the first and second buttons.

In another embodiment, a method of operating a window shade is described. The method includes providing a window shade including a fixed rail, a movable rail, a covering structure arranged between the fixed and movable rails, an electric motor operable to drive a displacement of the movable rail, a motor controller, and a control interface including a first, a second and a third button. Any of the first and second buttons is operated to cause displacement of the movable rail. While the movable rail remains in a current position, the method includes concurrently pressing the third button and one of the first and second buttons to record the current position as a limit position of the movable rail.

DETAILED DESCRIPTION OF THE EMBODIMENTS

Figure 1:
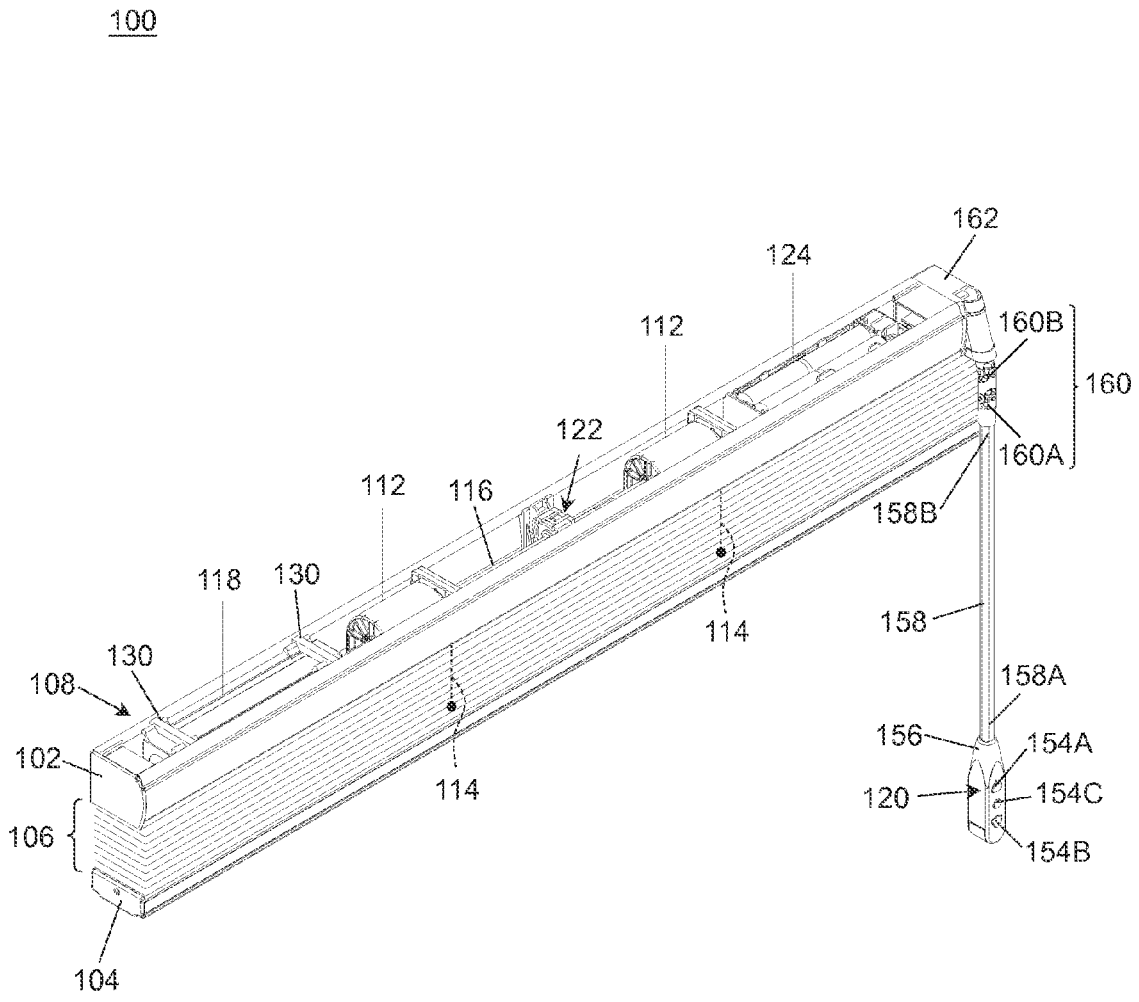
FIG. 1 is a perspective view illustrating an embodiment of a motorized window shade.

FIG. 1 is a perspective view illustrating one embodiment of a motorized window shade 100. The window shade 100 can typically be a vertical shade. The window shade 100 can include a fixed rail 102, a movable rail 104, and a covering structure 106 disposed between the fixed rail 102 and the movable rail 104. The fixed rail 102 can be a head rail that may be affixed at a top of a window frame. The movable rail 104 can be a bottom rail disposed at a bottom of the window shade 100. The covering structure 106 can have an upper end arranged adjacent to the fixed rail 102, and a lower end arranged adjacent to the movable rail 104. The movable rail 104 may be formed as an elongated rail or a weight element. In one embodiment, the covering structure 106 can be a honeycomb structure made of a fabric material, and include a plurality of cells. The honeycomb structure can have upper and lower ends respectively affixed with the fixed rail 102 and the movable rail 104. In other embodiments, the covering structure 106 may be formed by a plurality of slats suspended from the fixed rail 102.

Figure 2:
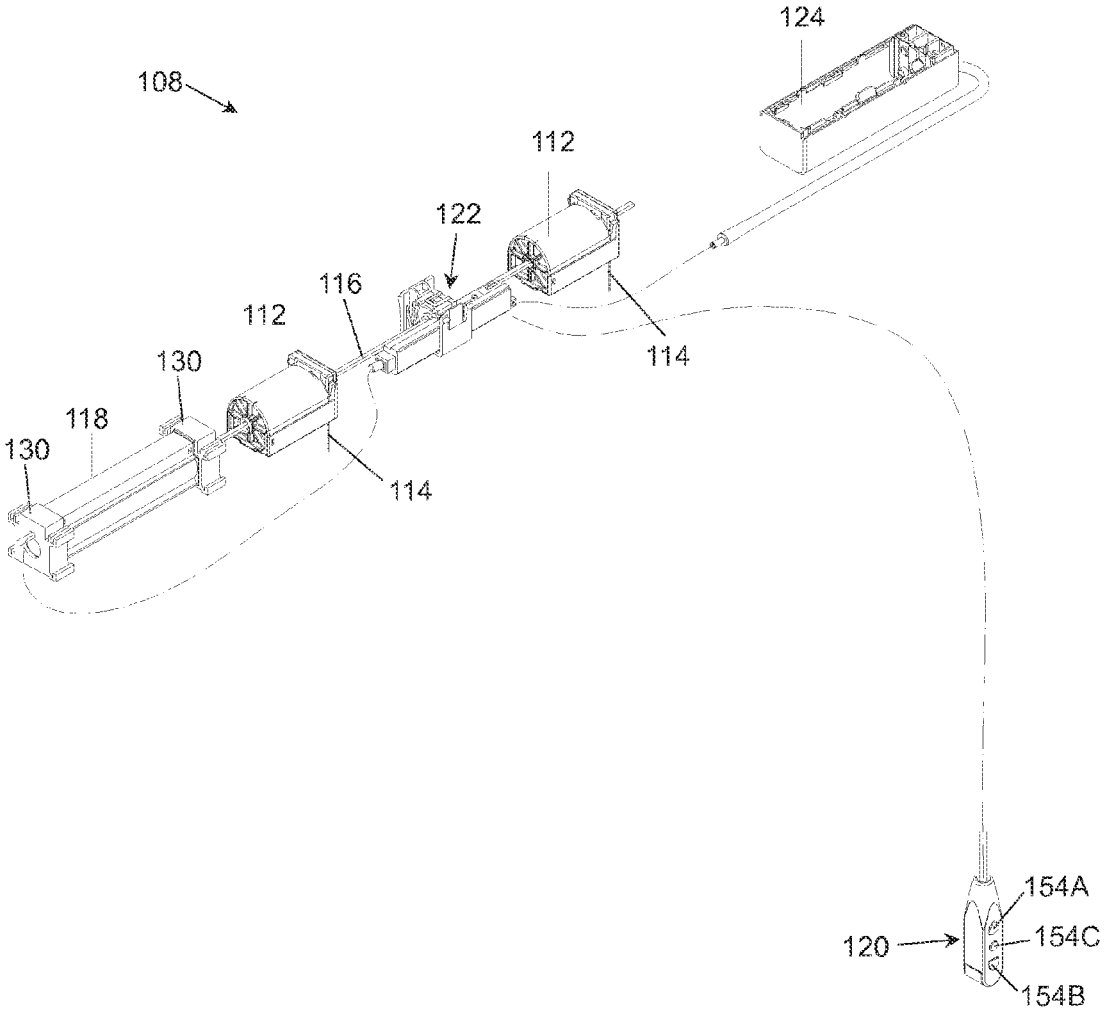
FIG. 2 is a schematic view illustrating a motorized actuating mechanism of the window shade.

In conjunction with FIG. 1, FIG. 2 is a schematic view illustrating a motorized actuating mechanism 108 of the window shade 100. The window shade 100 can also include a motorized actuating mechanism 108 operable to displace the movable rail 104 toward or away from the fixed rail 102 so as to collapse or expand the covering structure 106, and a control interface 120 operatively connected with the actuating mechanism 108. The actuating mechanism 108 can include a plurality of winding units 112, suspension cords 114 respectively associated with the winding units 112, a rotary axle 116, an electric motor 118, a motor controller 122 electrically coupled with the electric motor 118, and a power supply 124 electrically connected with the motor controller 122.

Figure 3:
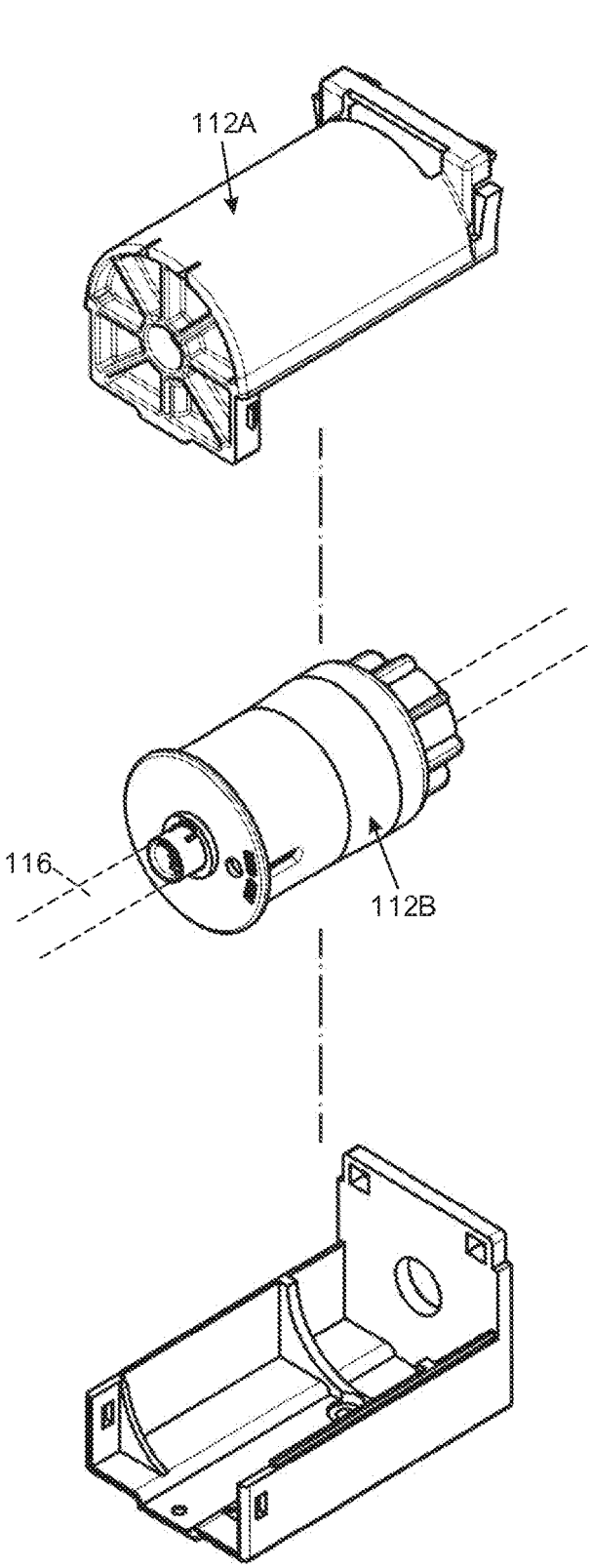
FIG. 3 is a schematic view illustrating the construction of a winding unit in the window shade.

The winding units 112 can be assembled in the fixed rail 102 at spaced-apart positions, and can be assembled coaxially about the rotary axle 116. FIG. 3 is a schematic view illustrating the construction of the winding unit 112. The winding unit 112 can exemplary include a casing 112A, and a drum 112B pivotally assembled in the casing 112A and assembled with the rotary axle 116. The winding units 112 thereby can be rotationally coupled with the rotary axle 116.

Each of the suspension cords 114 (as shown in FIG. 1) can have an upper end connected with the drum 112B of one corresponding winding unit 112, and a lower end connected with the movable rail 104. The movable rail 104 can be thereby suspended vertically below the fixed rail 102. The suspension cords 114 can pass through holes formed in the covering structure 106.

The rotary axle 116 can be assembled through the drum 112B of each winding unit 112, so that the drums 112B of the winding units 112 and the rotary axle 116 can rotate in unison.

Referring to FIGS. 1 and 2, the electric motor 118 can be assembled in the fixed rail 102 via a mount fixture. In one embodiment, the mount fixture can include two brackets 130 affixed in the fixed rail 102. An outer casing of the electric motor 118 can fit with the brackets 130 to be fixedly held in the fixed rail 102. The electric motor 118 can have an output rotationally coupled with the rotary axle 116, and can drive rotation of the rotary axle 116 in two opposite directions for raising and lowering the movable rail 104 relative to the fixed rail 102.

Figure 4:
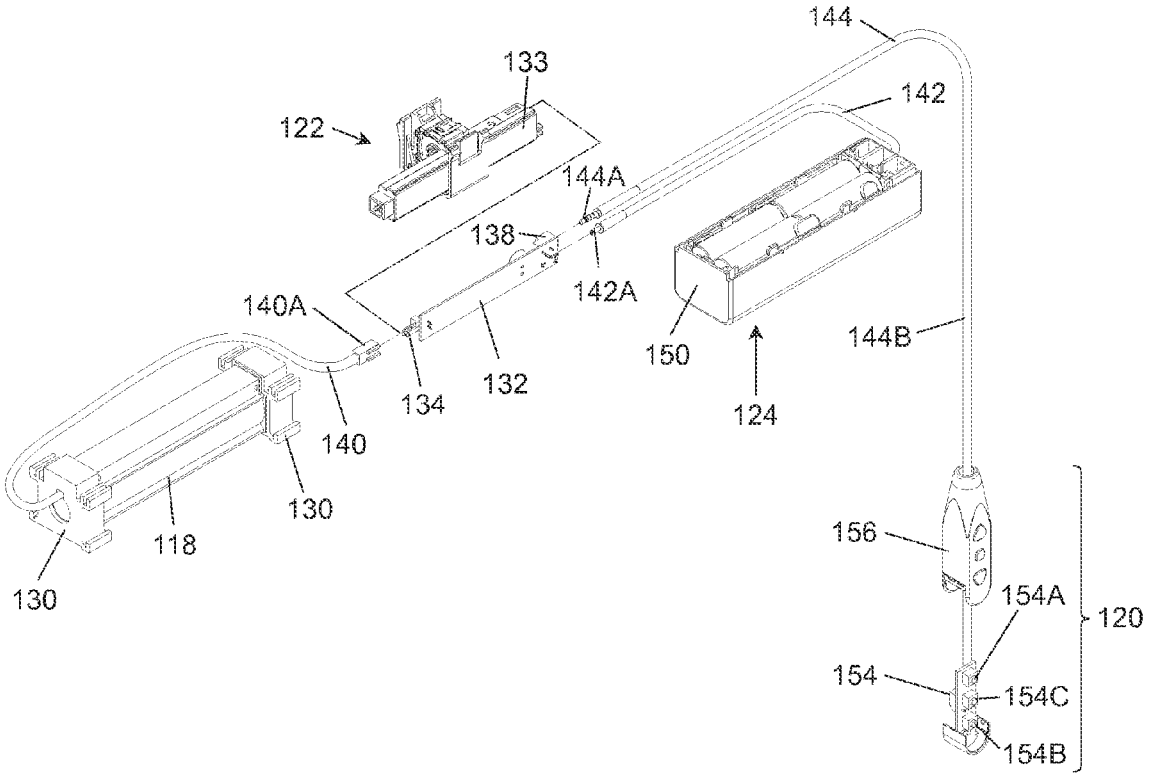
FIG. 4 is a schematic front view illustrating the circuitry connecting a motor controller, an electric motor, a power supply and a control interface used in the window shade.
Figure 5:
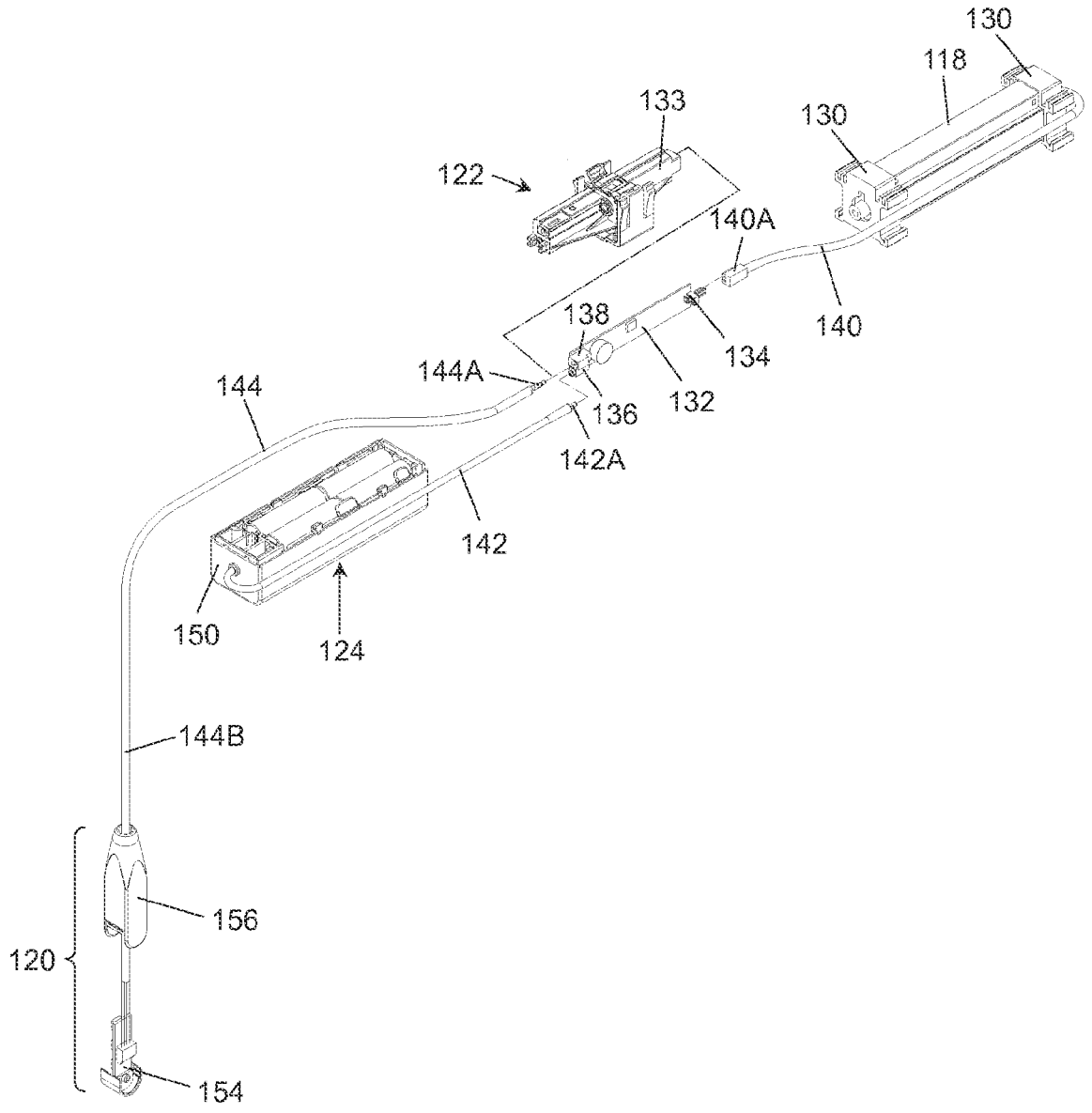
FIG. 5 is a schematic rear view illustrating the circuitry connecting the motor controller, the electric motor, the power supply and the control interface shown in FIG. 4.

FIGS. 4 and 5 are schematic front and rear views illustrating the circuitry connecting the motor controller 122, the electric motor 118, the power supply 124 and the control interface 120. The motor controller 122 can be arranged at a location spaced apart from the electric motor 118, the power supply 124 and the control interface 120. The motor controller 122 can include a circuit board 132 that is at least partially enclosed in a casing 133. The motor controller 122 can receive electrical signals from the control interface 120, control operation of the electric motor 118, and respectively transfer electric power received from the power supply 124 to the electric motor 118 and the control interface 120.

The circuit board 132 can include a plurality of connectors 134, 136 and 138 for electrical connections between the circuit board 132 and the electric motor 118, the power supply 124 and the control interface 120, respectively. For example, a cable 140 electrically connected with the electric motor 118 can have an end connector 140A that may connect with and disconnect from the connector 134 of the motor controller 122. A cable 142 electrically connected with the power supply 124 can have an end connector 142A that may connect with and disconnect from the connector 136 of the motor controller 122. A cable 144 electrically connected with the control interface 120 can have an end connector 144A that may connect with and disconnect from the connector 138 of the motor controller 122.

Figure 6:
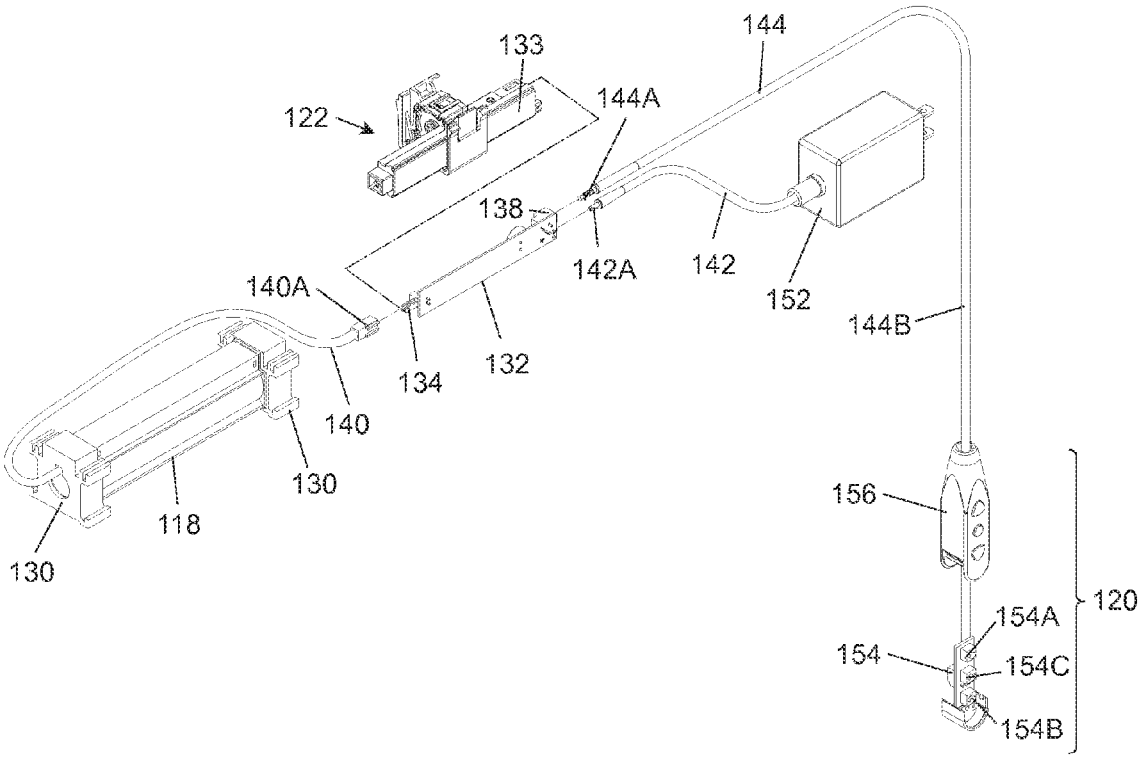
FIGS. 6 and 7 are schematic views illustrating another embodiment of an actuating mechanism used in the window shade in which the power supply is replaced with a transformer.
Figure 7:
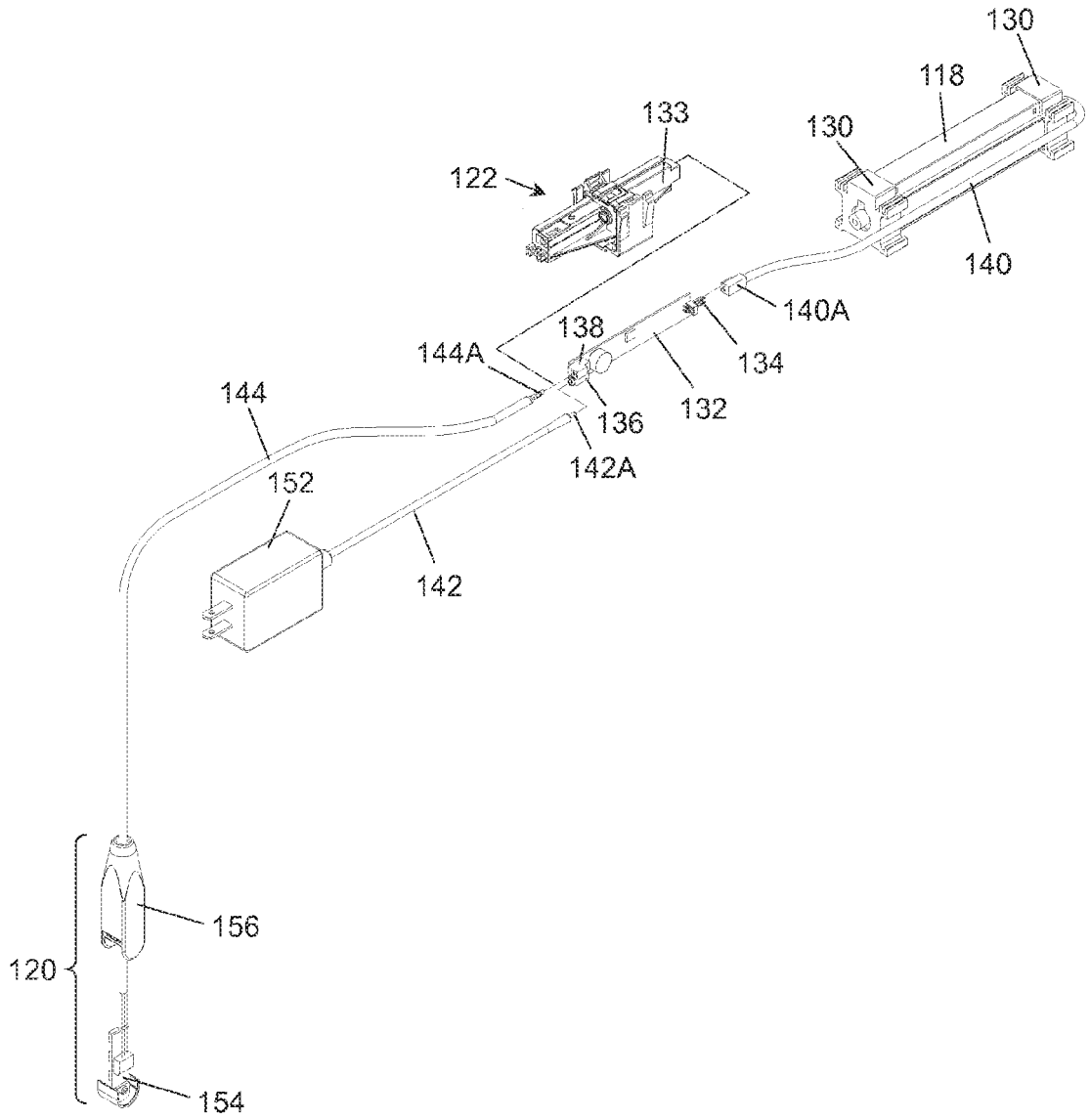

The use of detachable electric connection with the motor controller 122 can provide a more flexible and modular design, which allows easy replacement or change of the electric motor 118, power supply 124 and control interface 120. For example, FIGS. 4 and 5 show an embodiment in which the power supply 124 is a battery case 150, and FIGS. 6 and 7 show another embodiment in which the power supply 124 can be replaced with a transformer 152. The transformer 152 can be connected with the cable 142, and can plug and unplug on a wall AC outlet in a house.

The modular design also allows a more flexible placement of the motor controller 122, the electric motor 118 and the power supply 124 in the fixed rail 102. For example, the electric motor 118 and the power supply 124 can be disposed at two opposite sides in the fixed rail 102, and the motor controller 122 can be arranged between the electric motor 118 and the power supply 124. This arrangement may provide a better weight distribution in the fixed rail 102. Moreover, the motor controller 122 may be arranged at other locations outside the head rail 102. For example, another embodiment may assemble the motor controller 122 in a casing 156 of the control interface 120.

Upon actuation of the control interface 120, the motor controller 122 can issue various control signals to the electric motor 118 so as to control rotation of the electric motor 118 in either direction. Moreover, the motor controller 122 can be programmable to set multiple ranges of rotational displacement of the electric motor 118, which can correspond to upper, intermediate and lower limit positions of the movable rail 104. In addition, the motor controller 122 can further include other devices, such as a visual or audio alert device operable to emit light or a sound to notify a user of certain states of the window shade 100.

Referring to FIGS. 1, 2, and 4-7, the control interface 120 can include a circuit board 154 that is provided with at least three buttons 154A, 154B, 154C and is housed in a casing 156. The cable 144 can have a first terminal end electrically connected with the control interface 120, and a second terminal end arranged in the fixed rail 102. A segment 144B of the cable 144 extending outside the fixed rail 102 can be routed through an elongated tube 158 that extends vertically downward from a lateral end portion of the fixed rail 102. The elongated tube 158 can have a substantially linear shape that substantially encloses the segment 144B of the cable 144 outside the fixed rail 102. In one embodiment, the elongated tube 158 can be a hollow wand made of a plastic material and having a hollow interior through which is passed the cable 144. The elongated tube 158 can have an end 158A fixedly secured with the control interface 120 (e.g., affixed with the casing 156 of the control interface 120), and another end 158B connected with a pivotal joint 160 disposed outside the fixed rail 102. The end 158A of the elongated tube 158 can be secured with the casing 156, for example, through a slot and rib engagement. Other possible methods for attaching the end 158A of the elongated tube 158 with the casing 156 of the control interface 120 can include welding, gluing, and the like.

Referring to FIG. 1, a lateral end of the fixed rail 102 may be affixed with an end cap 162. The pivotal joint 160 may include a first joint part 160A that is affixed with the end 158B of the elongated tube 158, and a second joint part 160B that is affixed with the end cap 162 and is pivotally connected with the first joint part 160A. The first and second joint parts 160A and 160B can have tubular shapes for passage of the cable 144.

With the aforementioned construction, the control interface 120 can be suspended below the fixed rail 102 by the elongated tube 158. The length of the elongated tube 158 can be less than the maximum expansion of the covering structure 106, but sufficiently long so as to allow easy access to the control interface 120 held at the lower end 158A of the elongated tube 158. Moreover, the elongated tube 158 and the control interface 120 can pivot in unison about the pivotal joint 160 relative to the fixed rail 102 for facilitating grasping and manipulation of the control interface 120. Moreover, the elongated tube 158 can advantageously provide protection for the cable 144, which can prevent undesirable damages of the cable 144 and the risk of its accidentally lacing around the neck of a young child.

Referring again to FIGS. 1, 2, 4-7, the buttons 154A, 154B, 154C can be operable to control the vertical displacement of the movable rail 104 in upward and downward directions relative to the fixed rail 102. In one embodiment, pressing on the button 154A can cause the electric motor 118 to rotate for raising the movable rail 104 toward the fixed rail 102, and pressing on the button 154B can cause the motor 118 to rotate for lowering the movable rail 104 away from the fixed rail 102. The buttons 154A and 154B may be operated by applying a short pressure or a prolonged pressure. A continuous pressure on the button 154A for a prolonged time (e.g., more than 3 seconds) may activate a rise latching state that causes the electric motor 118 to continuously rotate for raising the movable rail 104, even after the button 154A is released. Likewise, a continuous pressure of the button 154B for a prolonged time (e.g., more than 3 seconds) may activate a descend latching state that causes the electric motor 118 to continuously rotate for lowering the movable rail 104, even after the button 154B is released. The rise or descend latching state may be deactivated by pressing on any of the buttons 154A, 154B and 154C.

The button 154C can also be operated to cause the movable rail 104 to move toward a preset intermediate limit position. For example, when the movable rail 104 is located below the preset intermediate limit position, pressing on the button 154C can cause the movable rail 104 to rise until it reaches and stops at the preset intermediate limit position. When the movable rail 104 is located above the preset intermediate limit position, pressing on the button 154C can cause the movable rail 104 to lower until it reaches and stops at the preset intermediate limit position.

The buttons 154A, 154B, 154C are also used to perform certain settings of the motor controller 122. In particular, the buttons 154A, 154B, 154C can be used to program an upper, an intermediate and a lower limit position of the movable rail 104.

Figure 8:
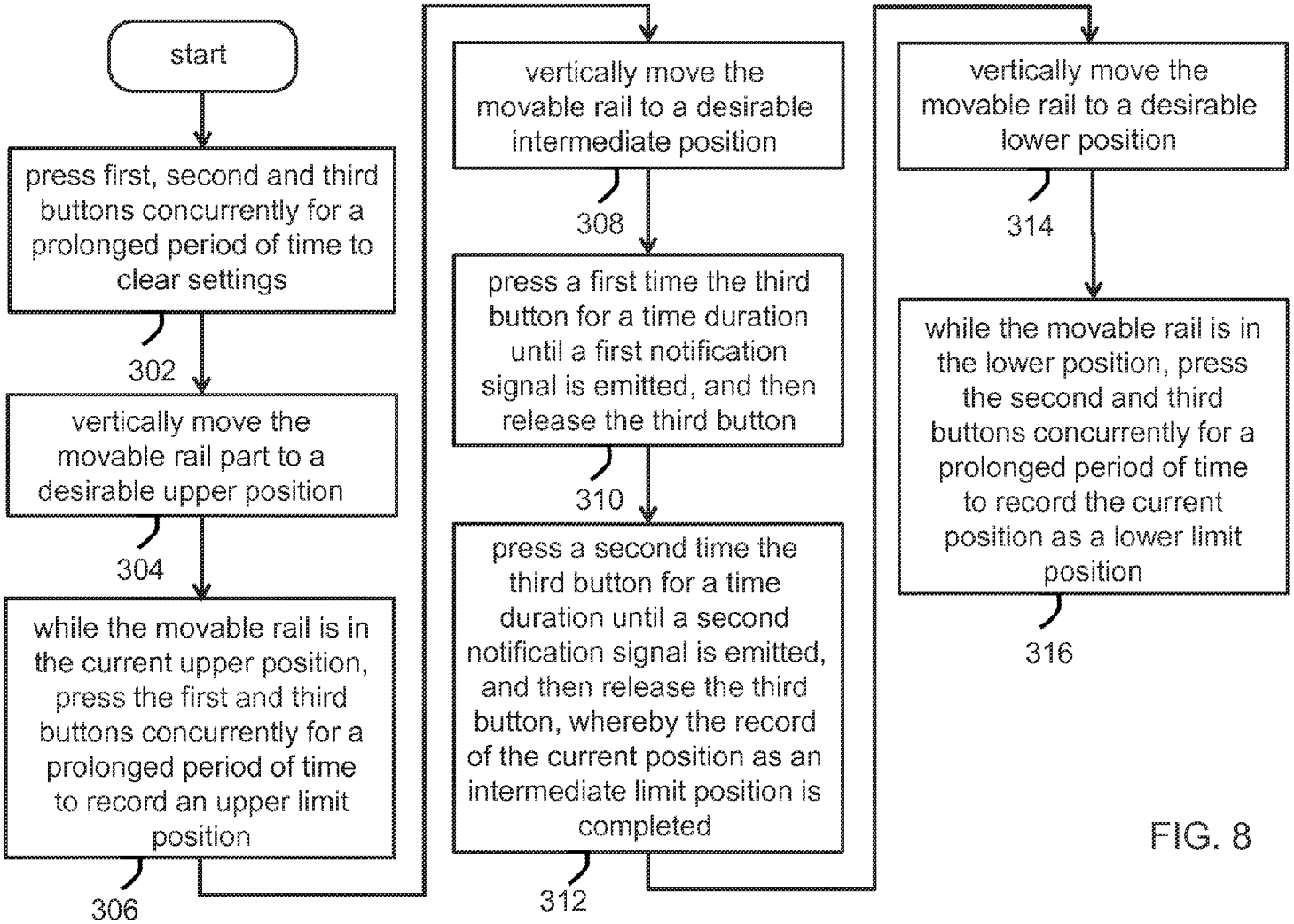
FIG. 8 is a flowchart of method steps for setting an upper, an intermediate and a lower limit position of the movable rail in the window shade.
Figure 9:
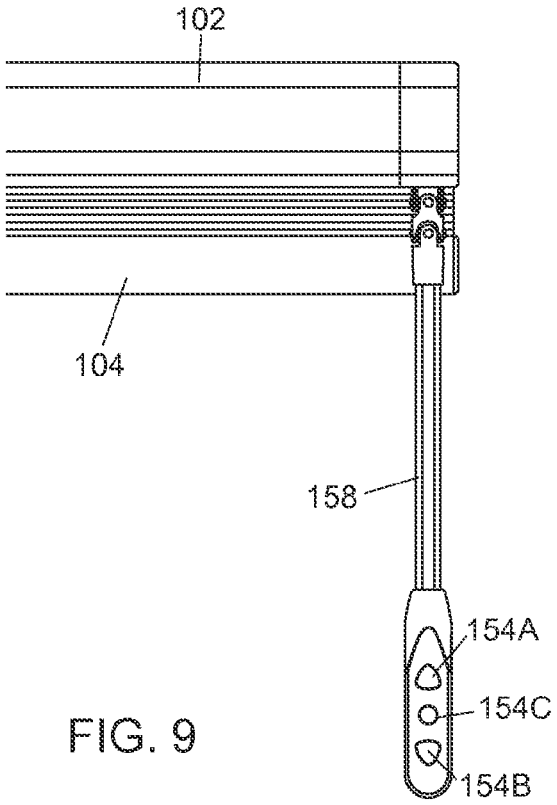
FIG. 9 is a schematic view illustrating an example of an upper limit position of the movable rail of the window shade.
Figure 10:
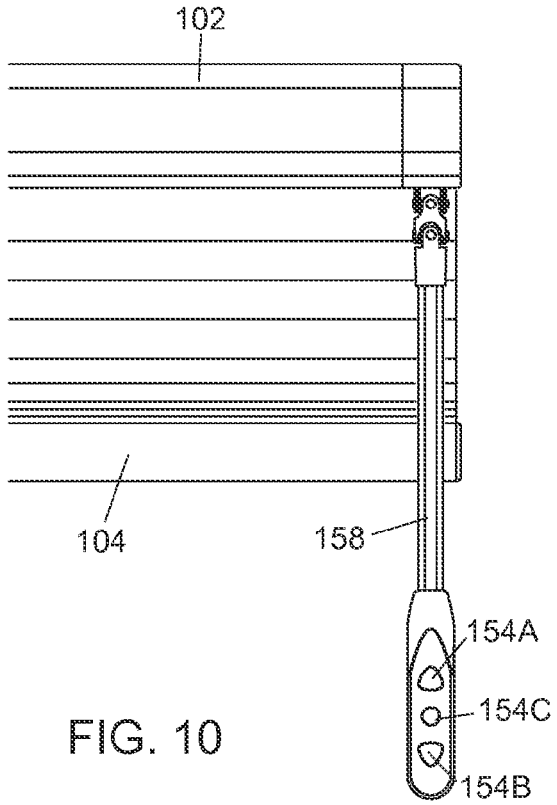
FIG. 10 is a schematic view illustrating an example of an intermediate limit position of the movable rail of the window shade.
Figure 11:
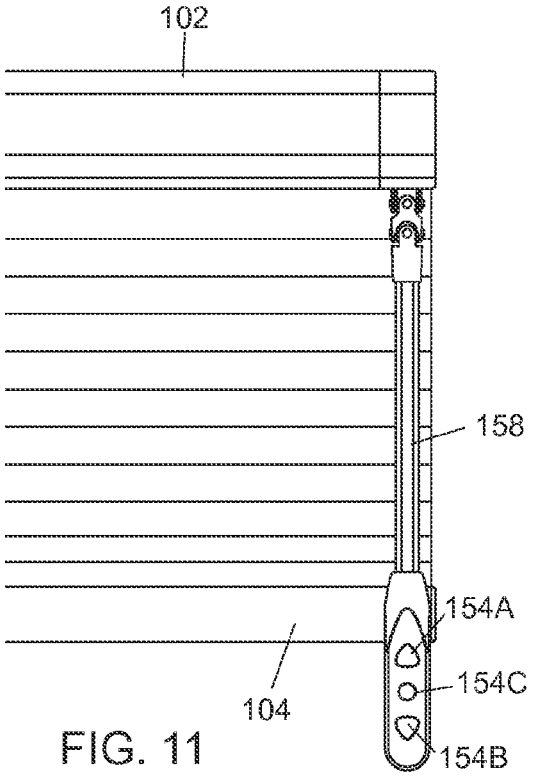
FIG. 11 is a schematic view illustrating an example of a lower limit position of the movable rail of the window shade.

FIG. 8 is a flowchart of method steps for setting an upper, an intermediate and a lower limit position of the movable rail 104, and FIGS. 9, 10 and 11 are schematic views respectively illustrating examples of the upper, intermediate and lower limit positions. In initial step 302, the three buttons 154A, 154B, 154C can be pressed concurrently in a continuous manner for a prolonged period of time (e.g., 3, 4, 5 seconds or longer) to reset and clear the current settings in the motor controller 122. In particular, any record of limit positions of the movable rail 104 may be deleted. A notification signal (e.g., a sound or light) may be emitted to indicate that the clearance of settings in the motor controller 122 is completed. Once the settings have been reset, the user can start the procedure for setting the upper, intermediate and lower limit positions of the movable rail 104.

In step 304, any of the buttons 154A and 154B can be pressed to displace the movable rail 104 vertically until it reaches a desirable upper position. It is noted that the motor controller 122 and the electric motor 118 may have a safety mechanism that can automatically stop the electric motor 118 in case the movable rail 104 has reached a top end position adjacent to the fixed rail 102. This may prevent excessive upward course of the movable rail 104 which may abruptly collide against the fixed rail 102. Once the movable rail 104 reaches the desirable upper position (as exemplary shown in FIG. 9), the buttons 154A and 154B can be released.

In next step 306, while the movable rail 104 remains stationary in the current upper position, the two buttons 154A and 154C can be pressed concurrently in a continuous manner for a prolonged period of time, e.g., 3 seconds, 4 seconds or longer. In response to the pressure concurrently applied on the buttons 154A and 154C, the motor controller 122 proceeds to record the current position of the movable rail 104 as an upper limit position of the movable rail 104. This record may be made by reading and saving position data of a rotor in the electric motor 118 associated with the current position of the movable rail 104. The motor controller 122 may operate to emit a notification signal (e.g., a sound or light) for indicating that the setting of the upper limit position is completed.

The record of the upper limit position as described in aforementioned step 306 thus can be performed in a simple way by operating only the two buttons 154A and 154C, whereas the button 154B is kept in a release state.

In step 308, the user can use any of the buttons 154A and 154B to vertically displace the movable rail 104 until it reaches a desirable intermediate position below the upper limit position. Once the movable rail 104 reaches the desirable intermediate position (as exemplary shown in FIG. 10), the buttons 154A and 154B can be released.

While the movable rail 104 remains stationary in the intermediate position, a first pressing action can be applied on the button 154C in step 310 for a time duration, until a first notification signal (e.g., a sound or light) is emitted. The buttons 154A and 154B are kept in a release state while the button 154C is pressed down. Upon emission of the first notification signal, the button 154C can be released.

After the first release of the button 154C, a second pressing action is applied again on the button 154C in step 312 for a certain time duration, until a second notification signal (e.g., a sound or light) is emitted to indicate that the record of the current position as an intermediate limit position is completed. While the button 154C is pressed down for the second time, the buttons 154A and 154B are likewise kept in the release state. Upon emission of the second notification signal, the button 154C can be released, and the record of the intermediate limit position is completed. Therefore, a sequence of two pressing actions can be successively applied on the button 154C to record the intermediate limit position. The record of the intermediate limit position can be performed in a simple way by only operating the button 154C, whereas the buttons 154A and 154B are kept in a release state.

It is noted that if no second pressing action were applied on the button 154C within a certain period of time after the first pressing action, the record procedure of the intermediate limit position is aborted. In this case, steps 310 and 312 have to be repeated to record the intermediate limit position.

In step 314, the user can use the buttons 154A and 154B to vertically displace the movable rail 104 until it reaches a desirable lower position below the intermediate limit position. Once the movable rail 104 reaches the desirable lower position (as exemplary shown in FIG. 11), the buttons 154A and 154B can be released.

In step 316, while the movable rail 104 remains stationary in the current lower position, the two buttons 154B and 154C can be pressed concurrently in a continuous manner for a prolonged period of time, e.g., 3 seconds, 4 seconds or a longer time. In response to the pressure concurrently applied on the buttons 154B and 154C, the motor controller 122 records the current position of the movable rail 104 as a lower limit position of the movable rail 104. This record may be made by determining position data of a rotor in the electric motor 118 associated with the current lower position of the movable rail 104. The motor controller 122 may emit a notification signal (e.g., a sound or light) for indicating that the setting of the lower limit position is completed.

The record of the lower limit position as described in aforementioned step 316 can be performed in a simple way by operating only the two buttons 154B and 154C, whereas the button 154A is kept in a release state.

It will be understood that the aforementioned settings of the upper, intermediate and lower limit positions of the movable rail 104 may be performed in any order. The motor controller 122 can track the number of revolutions performed by the electric motor 118 in either direction, and respectively record the distance between the upper and lower limit position, the distance between the upper and intermediate limit position, and the distance between the lower and intermediate limit position. In case no operation is performed within a time interval (e.g., 6 seconds or longer) after the completion of the settings, the motor controller 122 can automatically switch to an idle mode for saving power.

Once the settings of the upper, intermediate and lower limit positions of the movable rail 104 are completed, the user can use any of the buttons 154A, 154B and 154C to adjust the height of the movable rail 104. By counting the revolutions of the electric motor 118, the motor controller 122 can detect when the movable rail 104 reaches any of the preset limit positions, and automatically stop the electric motor 118 so that the movable rail 114 is prevented from moving beyond the preset ranges of displacement.

Figure 12:
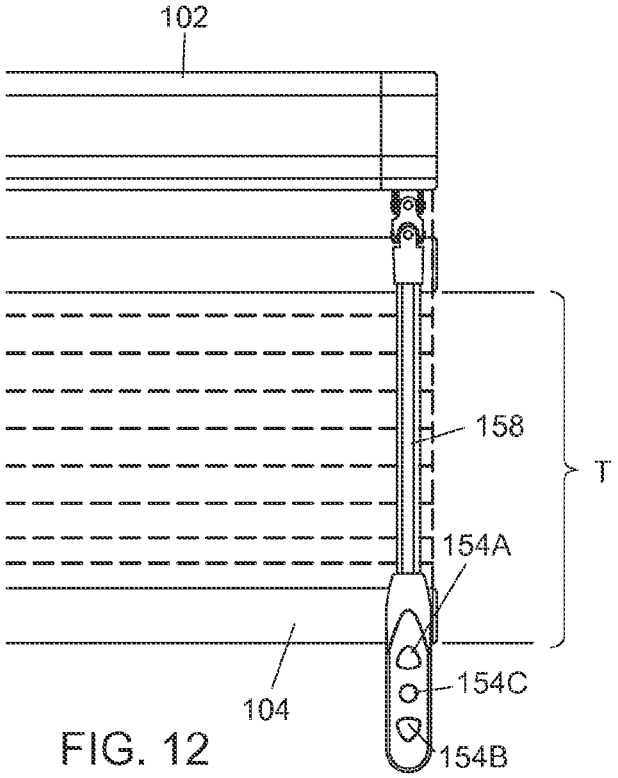
FIG. 12 is a schematic view illustrating a use of the window shade within a preset range between the upper and lower limit positions.

Referring to FIG. 12, in case the user wants to use the window shade 100 within a preset range T between the upper and lower limit positions, the buttons 154A and 154B can be used to move the movable rail 104 vertically to any position between the upper and lower limit positions. For example, the button 154A can be pressed to raise the movable rail 104, and the button 154B can be pressed to lower the movable rail 104. Any of the buttons 154A and 154B may be pressed for a prolonged period of time so as to activate a latching state that causes the electric motor 118 to continuously rotate for either raising or lowering the movable rail 104, even after release of the button. The vertical course of the movable rail 104, when controlled by the operation of the buttons 154A and 154B, is only limited by the preset upper and lower limit positions and can travel past the preset intermediate limit position. When the window shade 100 is adjusted by using the buttons 154A and 154B, the movable rail 104 can automatically stop when it reaches the upper or lower limit position.

Figure 13:
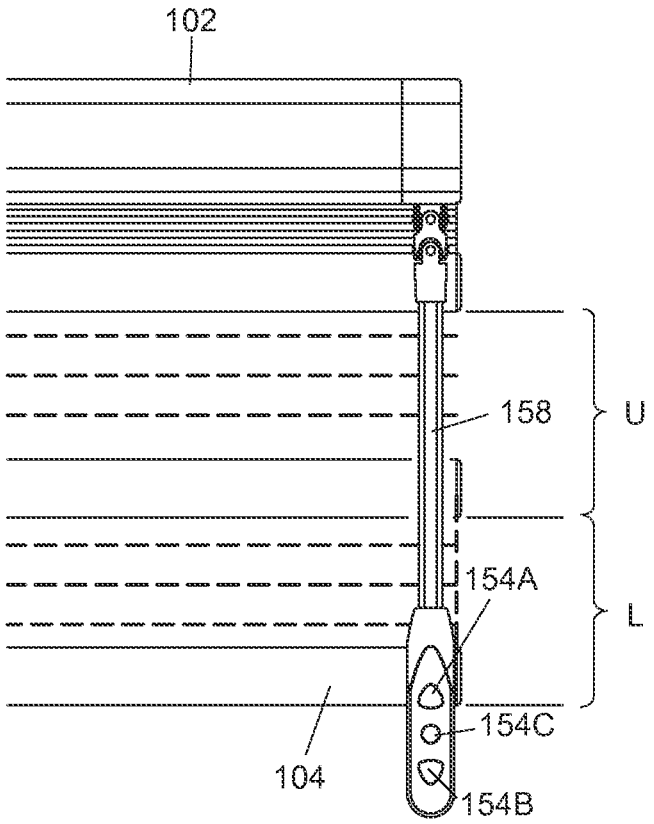
FIG. 13 is a schematic view illustrating a use of the window shade within a first preset range between the upper and intermediate limit positions, and a second preset range between the intermediate and lower limit positions.

Referring to FIG. 13, in case the user wants to use the window shade 100 within a preset range U between the upper and intermediate limit positions, the buttons 154A and 154C can be used to move the movable rail 104 vertically to any position between the upper and intermediate limit positions. For example, the button 154A can be pressed to raise the movable rail 104, and the button 154C can be pressed to lower the movable rail 104 toward the intermediate limit position. Any of the buttons 154A and 154C may be pressed for a prolonged period of time so as to activate a latching state that causes the electric motor 118 to continuously rotate for either raising or lowering the movable rail 104, even after release of the button. The vertical course of the movable rail 104, when controlled by operating the buttons 154A and 154C, is limited by the preset upper and intermediate limit positions. In other words, when the window shade 100 is adjusted by using the buttons 154A and 154C, the movable rail 104 can automatically stop when it reaches the upper or intermediate limit position.

In case the user wants to use the window shade 100 within a preset range L between the intermediate and lower limit positions, the buttons 154B and 154C can be used to move the movable rail 104 vertically to any position between the lower and intermediate limit positions. For example, the button 154C can be pressed to raise the movable rail 104 toward the intermediate limit position, and the button 154B can be pressed to lower the movable rail 104 toward the lower limit position. Any of the buttons 154B and 154C may be pressed for a prolonged period of time so as to activate a latching state that causes the electric motor 118 to continuously rotate for either lowering or raising the movable rail 104, even after release of the button. The vertical course of the movable rail 104, when controlled by operating the buttons 154B and 154C, is limited by the preset intermediate and lower limit positions. In other words, when the window shade 100 is adjusted by using the buttons 154B and 154C, the movable rail 104 can automatically stop when it reaches the intermediate or lower limit position.

If the user wants to clear all the settings, the three buttons 154A, 154B, 154C can be pressed concurrently in a continuous manner for a prolonged period of time, e.g., 4, 5 seconds or longer. New settings of the upper, intermediate and lower limit positions of the movable rail 104 then can be performed as described previously. It is noted that the settings can be kept in the motor controller 122 even when power supply disruption occurs, e.g., during battery replacement. When no settings are made, the buttons 154A and 154B can be operated to raise and lower the movable rail 104 to any positions.

In some embodiments, the motor controller 122 may further be configured to enter a power saving mode when none of the buttons 154A, 154B, 154C are operated for more than a preset time interval, e.g., for 6 seconds or longer. This may allow to reduce power consumption of the circuit board 132.

Figure 14:
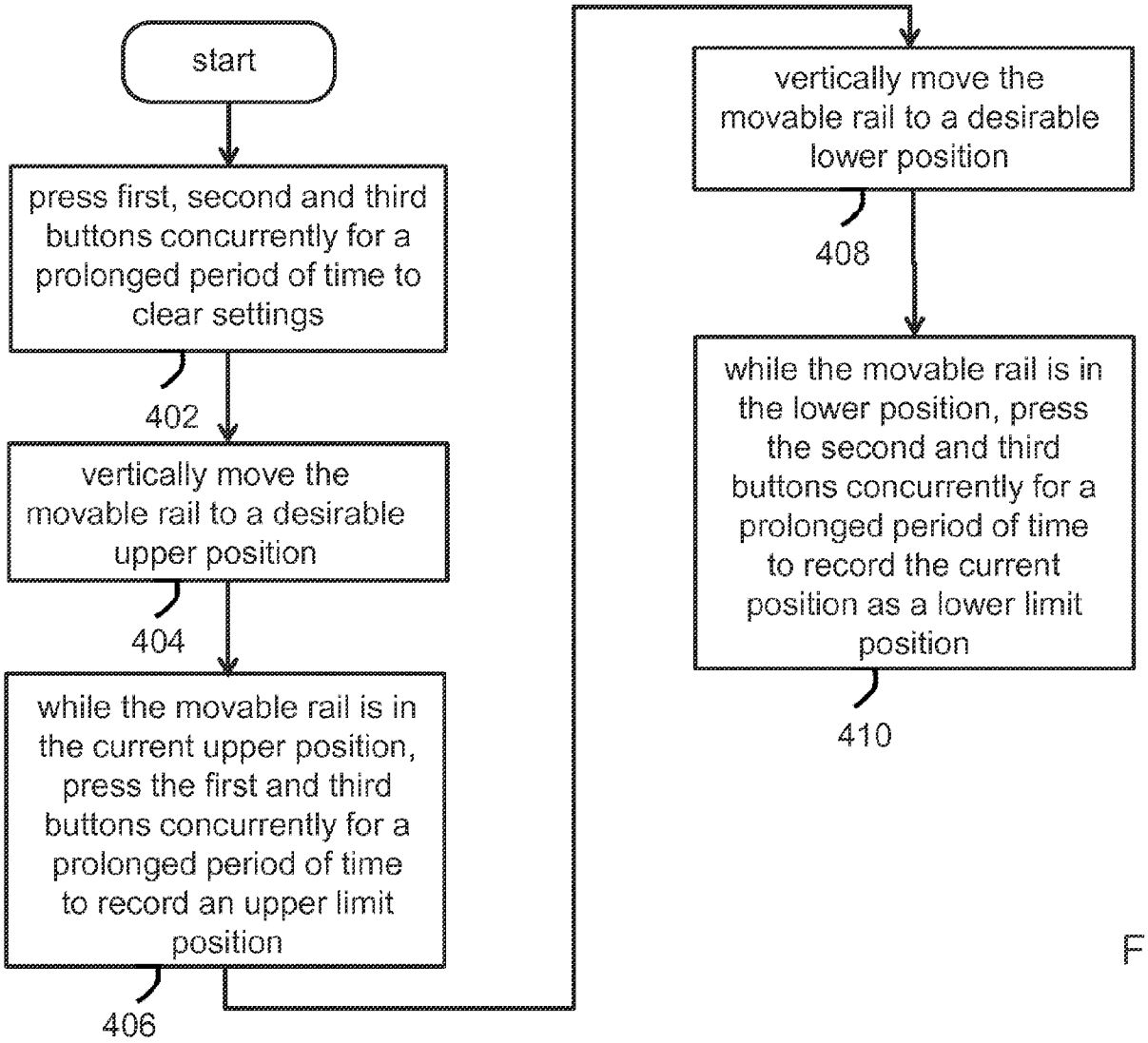
FIG. 14 is a flowchart of method steps for setting an upper and a lower limit position of the movable rail in the window shade.

It will be appreciated that the setting of limit positions as described above may be implemented in different embodiments of window shades. FIG. 14 is a flowchart of method steps for setting an upper and a lower limit position of the movable rail 104 in an embodiment of a window shade having no setting of intermediate limit position. Like previously described, the three buttons 154A, 154B, 154C in initial step 402 can be pressed concurrently in a continuous manner for a prolonged period of time (e.g., 4, 5 seconds or longer) to reset and clear the settings of limit positions of the movable rail 104 in the motor controller 122. A notification signal (e.g., a sound or light) may be emitted to indicate that the clearance of settings in the motor controller 122 is completed.

In step 404, any of the buttons 154A and 154B can be pressed to displace the movable rail 104 vertically until it reaches a desirable upper position. Once the movable rail 104 reaches the desirable upper position, the buttons 154A and 154B can be released.

In next step 406, while the movable rail 104 remains stationary in the current upper position, the two buttons 154A and 154C can be pressed concurrently in a continuous manner for a prolonged period of time, e.g., 3 seconds, 4 seconds or longer. In response to the pressure concurrently applied on the buttons 154A and 154C, the motor controller 122 proceeds to record the current position of the movable rail 104 as an upper limit position of the movable rail 104. This record may be made by reading and saving position data in the electric motor 118 associated with the current position of the movable rail 104. The motor controller 122 may operate to emit a notification signal (e.g., a sound or light) for indicating that the setting of the upper limit position is completed.

In step 408, the user can use the buttons 154A and 154B to vertically displace the movable rail 104 until it reaches a desirable lower position below the upper limit position. Once the movable rail 104 reaches the desirable lower position, the buttons 154A and 154B can be released.

In step 410, while the movable rail 104 remains stationary in the current lower position, the two buttons 154B and 154C can be pressed concurrently in a continuous manner for a prolonged period of time, e.g., 3 seconds, 4 seconds or longer. In response to the pressure concurrently applied on the buttons 154B and 154C, the motor controller 122 records the current position of the movable rail 104 as a lower limit position of the movable rail 104. This record may be made by reading position data in the electric motor 118 associated with the current lower position of the movable rail 104. The motor controller 122 may emit a notification signal (e.g., a sound or light) indicating that the setting of the lower limit position is completed.

The record of the upper and lower limit positions as described in the aforementioned steps can be performed in a simple way by operating only two buttons at a time. Once the setting of the upper and lower limit positions are completed, the control interface 120 can be operated to displace the movable rail 104 within the preset range between the upper and lower limit positions.

It is worth noting that the aforementioned structures and methods are not limited to vertical window shades. In other embodiments, the features described herein may also be implemented in horizontal window shades in which the movable rail can move horizontally relative to the fixed rail to expand or collapse the covering structure.

The motorized window shades described herein include a motor controller that is coupled with a control interface having three buttons. The motor controller can record limit positions in a simple and easy way through operation of the three buttons of the control interface.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A window shade comprising:

a fixed rail, a movable rail, and a covering structure arranged between the fixed rail and the movable rail;

an electric motor operable to drive displacement of the movable rail relative to the fixed rail;

a control interface operable to control operation of the electric motor, the control interface including a first, a second and a third button, the first button being operable to cause displacement of the movable rail in a first direction, and the second button being operable to cause displacement of the movable rail in a second direction opposite to the first direction; and a motor controller respectively connected with the electric motor and the control interface, wherein the motor controller is configured to:

record a first position of the movable rail as a first limit position of the movable rail in response to a pressure concurrently applied on the third button and the first button;

record a second position of the movable rail as an intermediate limit position of the movable rail in response to a sequence of a first and a second pressing action successively applied on the third button; and record a third position of the movable rail as a second limit position of the movable rail in response to a pressure concurrently applied on the third button and the second button, the intermediate limit position being located between the first and second limit positions.

2. The window shade according to claim 1, wherein the first button is operable to cause an upward displacement of the movable rail, the second button is operable to cause a downward displacement of the movable rail, and the first and second limit positions are respectively an upper limit position and a lower limit position beyond which displacement of the movable rail is prevented.

3. The window shade according to claim 1, wherein the motor controller is further configured to emit a notification signal indicating that the record of the first or second limit position is completed.

4. The window shade according to claim 3, wherein the notification signal is emitted when the third button and one of the first and second button are concurrently pressed over a period of time of 3 seconds or longer.

5. The window shade according to claim 1, wherein the motor controller is configured to record the intermediate limit position after the record of the first limit position is completed.

6. The window shade according to claim 1, wherein the motor controller is further configured to:

emit a first notification signal when the first pressing action has been applied on the third button for a predetermined first time duration; and emit a second notification signal when the second pressing action has been applied on the third button for a predetermined second time duration.

7. The window shade according to claim 1, wherein the third button is further operable to cause displacement of the movable rail toward the intermediate limit position, once the recording of the intermediate limit position is completed.

8. The window shade according to claim 7, wherein the movable rail is movable vertically relative to the fixed rail, when the movable rail is located above the intermediate limit position, a pressure on the third button causes a downward displacement of the movable rail, and when the movable rail is located below the intermediate limit position, a pressure on the third button causes an upward displacement of the movable rail.

9. The window shade according to claim 1, wherein the motor controller is further configured to clear any record of limit positions of the movable rail in response to a pressure concurrently applied on all of the first, second and third buttons.

10. The window shade according to claim 1, wherein the motor controller is arranged at a location spaced apart from the electric motor, and is respectively connected with the electric motor and the control interface via electric cables.

11. The window shade according to claim 10, further including a power supply spaced apart from the electric motor, power from the power supply being transmitted through the motor controller to the electric motor.

12. A method of operating a window shade, comprising:

providing a window shade including a fixed rail, a movable rail, a covering structure arranged between the fixed and movable rails, an electric motor operable to drive a displacement of the movable rail, a motor controller, and a control interface including a first, a second and a third button;

operating any of the first and second buttons to cause displacement of the movable rail, the first button being operable to cause displacement of the movable rail in a first direction, and the second button being operable to cause displacement of the movable rail in a second direction opposite to the first direction;

while the movable rail remains in a first position, concurrently pressing the third button and the first button to record the first position as a first limit position of the movable rail;

displacing the movable rail to a second position away from the first limit position, and successively applying a first and a second pressing action on the third button to record the second position as an intermediate limit position; and displacing the movable rail to a third position, and concurrently pressing the third button and the second button to record the third position as a second limit position of the movable rail, the intermediate limit position being located between the first and second limit positions.

13. The method according to claim 12, wherein before the step of concurrently pressing the third button and the first button, the method further includes:

releasing the first and second buttons so that the movable rail remains stationary in the first position.

14. The method according to claim 12, wherein displacement of the movable rail in the first direction beyond the first limit position, and displacement of the movable rail in the second direction beyond the second limit position are prevented after the first and second limit positions are recorded.

15. The method according to claim 12, wherein either of the first and second limit position is recorded by concurrently pressing the third button and either of the first and second buttons over a period of time of 3 seconds or longer.

16. The method according to claim 12, further including:

concurrently pressing the first, second and third buttons to clear any record of limit positions of the movable rail.

17. The method according to claim 12, further including emitting a notification signal indicating that the record of the first or second limit position is completed.

18. The method according to claim 12, wherein the step of successively applying a first and a second pressing action on the third button to record the second position as an intermediate limit position includes:

applying the first pressing action on the third button until a first notification signal is emitted;

in response to the first notification signal, releasing the third button a first time and then applying the second pressing action on the third button until a second notification signal is emitted; and in response to the second notification signal, releasing the third button a second time.

19. The method according to claim 12, wherein once the intermediate limit position is recorded, the method further includes:

while the movable rail is located between the first limit position and the intermediate limit position, pressing the third button to cause the movable rail to move in the second direction toward the intermediate limit position; and while the movable rail is located between the intermediate limit position and the second limit position, pressing the third button to cause the movable rail to move in the first direction toward the intermediate limit position.

20. A window shade comprising:

a fixed rail, a movable rail, and a covering structure arranged between the fixed rail and the movable rail;

an electric motor operable to drive displacement of the movable rail relative to the fixed rail;

a control interface operable to control operation of the electric motor, the control interface including a first, a second and a third button, the first button being operable to cause displacement of the movable rail in a first direction, and the second button being operable to cause displacement of the movable rail in a second direction opposite to the first direction; and a motor controller respectively connected with the electric motor and the control interface, wherein the motor controller is configured to:

record a first and a second limit position of the movable rail, the first limit position being recorded in response to actuation of the third button and the first button, and the second limit position being recorded in response to actuation of the third button and the second button;

record an intermediate limit position of the movable rail in response to actuation of the third button, the intermediate limit position being located between the first and second limit positions; and control rotation of the electric motor for displacing the movable rail toward the intermediate limit position in response to a pressure applied on the third button.

21. The window shade according to claim 20, wherein the motor controller is configured to record the intermediate limit position of the movable rail in response to a sequence of a first and a second pressing action successively applied on the third button.

22. The window shade according to claim 20, wherein the third button is operable to cause displacement of the movable rail in the second direction toward the intermediate limit position when the movable rail is located between the first limit position and the intermediate limit position, and the third button is operable to cause displacement of the movable rail in the first direction toward the intermediate limit position when the movable rail is located between the intermediate limit position and the second limit position.

23. The window shade according to claim 20, wherein the motor controller is configured to record the first limit position in response to a pressure concurrently applied on the third button and the first button, and to record the second limit position in response to a pressure concurrently applied on the third button and the second button.

* * * * *